US005588487A

United States Patent [19]

Bryant

[11] Patent Number: 5,588,487

[45] Date of Patent: Dec. 31, 1996

[54] TOOL FOR BLOCKING AXIAL FLOW IN GRAVEL-PACKED WELL ANNULUS

[75] Inventor: David W. Bryant, Abita Springs, La.

[73] Assignee: Mobil Oil Corporation, Fairfax, Va.

[21] Appl. No.: 527,116

[22] Filed: Sep. 12, 1995

[51] Int. Cl.[6] ..... E21B 43/04; E21B 43/08

[52] U.S. Cl. ..... 166/51; 166/227; 166/278; 166/242.6

[58] Field of Search ..... 166/51, 278, 276, 166/191, 202, 115, 227, 242.6

[56] References Cited

U.S. PATENT DOCUMENTS

| | | | |
|---|---|---|---|
| 3,637,010 | 1/1972 | Maly et al. | 166/51 |
| 4,945,991 | 8/1990 | Jones | 166/278 |
| 5,082,052 | 1/1992 | Jones et al. | 166/51 |
| 5,113,935 | 5/1992 | Jones et al. | 166/51 |
| 5,161,613 | 11/1992 | Jones | 166/242 |
| 5,161,618 | 11/1992 | Jones et al. | 166/308 |
| 5,333,688 | 8/1994 | Jones et al. | 166/278 |
| 5,341,880 | 8/1994 | Thorstensen et al. | 166/278 |
| 5,366,009 | 11/1994 | Cornette et al. | 166/51 |
| 5,390,966 | 2/1995 | Cox et al. | 285/137.1 |
| 5,419,394 | 5/1995 | Jones | 166/51 |
| 5,515,915 | 5/1996 | Jones et al. | 166/227 X |

*Primary Examiner*—Stephen J. Novosad

*Attorney, Agent, or Firm*—Malcolm D. Keen; Lawrence O. Miller

[57] ABSTRACT

A well screen for gravel-packing a wellbore interval comprising at least two joints connected by a well tool. Each joint is comprised of a length of screen section which has at least one, axially-extending shunt conduit thereon for carrying gravel slurry to different levels within the interval. The well tool has at least one by-pass tube therein which is adapted to align with and fluidly-connect the shunt conduits on respective joints whereby gravel can flow from one of the shunt conduit, through the by-pass tube, and into and out of the other shunt conduit. A packing means is mounted on the tool for preventing any substantial annular, axial flow past the tool when the tool is an operable position within the wellbore.

13 Claims, 1 Drawing Sheet

TOOL FOR BLOCKING AXIAL FLOW IN GRAVEL-PACKED WELL ANNULUS

DESCRIPTION

1. Technical Field

The present invention relates to a tool for blocking axial flow through a gravel-packed well annulus and in one of its aspects relates to a tool having by-passes for gravel-packing multi-zones within a completion interval in a single operation which allows the gravel be adequately distributed over the interval but will block any substantially axial flow through the gravel-packed annulus between productive zones of the interval after the gravel has been placed.

2. Background

In producing hydrocarbons or the like from unconsolidated and/or fractured subterranean formations, it is common to produce large volumes of particulate material (e.g. hereinafter referred to as "sand") along with the formation fluids. If not controlled, this produced sand can cause a variety of problems which, in turn, adds substantially to the operating costs and downtime of the producing well. Therefore, it is extremely important to control the production of sand in such operations.

"Gravel packing" is probably the most common technique used for controlling the production of sand from a well. In a typical gravel pack completion, a screen or the like is lowered into the wellbore and positioned adjacent the interval of the well which is to be completed. Particulate material, collectively referred to as gravel, is then pumped in a liquid slurry down a workstring and into the well annulus surrounding the screen.

The liquid in the slurry is "lost" into the formation and/or flows through the openings in the screen which results in the gravel being deposited or "screened out" in the annulus around the screen. The gravel is sized so that it forms a permeable mass between the screen and the producing formation which allows flow of the produced fluids therethrough and into the screen while substantially blocking the flow of any particulate material ("sand") therethrough.

A major problem associated with gravel packing, especially where thick or inclined production intervals are to be completed, is the poor distribution of gravel (i.e. incomplete packing of the interval resulting in voids in the gravel pack) which is often caused by the premature loss of liquid from the gravel slurry into the formation. This fluid loss can cause "sand bridges" to form in the annulus before all of the gravel has been placed. These bridges block further flow of the slurry through the well annulus thereby preventing the placement of sufficient gravel (a) below the bridge for top-to-bottom packing operations or (b) above the bridge, for bottom-to-top packing operations.

Recently, well tools have been developed for providing a good distribution of gravel throughout the desired interval even where sand bridges may form in the annulus before all the gravel has been deposited. These tools (e.g. well screens) include a plurality of "alternate flowpaths" (e.g. perforated shunts or conduits) which extend along the screen and receive gravel slurry as it enters the wellbore annulus. If a sand bridge forms before all of the gravel is placed, the slurry will by-pass the sand bridge and will flow out through the spaced perforations in the shunt conduits at different levels within the annulus to thereby complete the filling of the annulus above and/or below the bridge. For complete details of such well tools, see U.S. Pat. Nos. 4,945,991; 5,082,052; 5,113,935; and 5,333,688; all of which are incorporated herein by reference.

Well tools having alternate flowpaths such as those described above have proved successful in completing relatively thick wellbore intervals (i.e. 100 feet or more) in a single operation. However, there is still a problem in completing these thick intervals even where good gravel distribution is initially achieved; this problem being due to the fact that certain zones within the interval are likely to "water-out" before other productive zones. When this occurs, the watered-out zone(s) will produce substantially only water which is obviously undesirable and economically unacceptable. Therefore, it is desirable to block flow from such watered-out zone(s) while continuing the production only from the more productive zones.

Typically, when a zone begins to produce unacceptable amounts of water, flow into the well screen adjacent that zone is blocked (e.g. by cementing, closing a sliding sleeve, or the like) as will be understood by those skilled in the art. While this prevents flow of water into the screen adjacent the watered-out zone, unfortunately, water from the watered-out zone can still flow through the gravel-packed annulus and into the screen adjacent the still productive zone(s). Accordingly, when a thick wellbore interval is gravel packed, it is important that axial flow through the annulus between the different zones be substantially restricted once the flow from a watered-out zone into the screen is blocked.

Before the development of the "alternate flowpath" technology, a series of individual operations was used to gravel-pack thick, wellbore interval. That is, a first zone would be isolated with packers or the like and then gravel-packed after which a second zone would be isolated and gravel-packed, and so forth, until the entire interval was completed. The packers used to isolate the zones were left in place which also served to block axial flow through the well annulus between the individually packed zones so that when the flow of water was blocked into the screen adjacent a watered-out zone, it could not flow through the annulus into the screen adjacent a still producing zone.

With the advent of "alternate flowpath" technology wherein a thick interval can be gravel-packed in a single operation, the individual zones no longer have to be packed off to accomplish a good disbursement of travel throughout the interval. However, there still exists the need for blocking flow through the annulus between the zones in a thick interval.

SUMMARY OF THE INVENTION

The present invention provides a well screen for gravel-packing an interval within a wellbore which is comprised of at least two joints connected by a well tool. Each joint is comprised of a length of screen section which has at least one, axially-extending shunt conduit thereon for carrying gravel slurry to different levels within the interval.

The well tool has at least one by-pass tube therein which is adapted to align with and connect the shunt conduits on the respective joints of the well screen whereby gravel slurry can flow from one of the shunt conduit, through the by-pass tube, and into the other shunt conduit. A means, e.g. cup packers, is mounted on the well tool for preventing axial flow of fluids past the tool when the well screen is in an operable position within the wellbore whereby flow cannot occur through the well annulus between zones after the interval has been gravel-packed.

More particularly, the present well screen is comprised of a plurality of similar lengths or "joints", each of which is comprised of a length or section of screen. As used herein, "screen" is intended to mean any fluid-permeable structure commonly used in gravel pack operations; (e.g. commercially-available screens, porous or permeable pipe, slotted or perforated liners or pipes, screened pipes, prepacked screens and/or liners, or combinations thereof). Axially-extending along the length of each joint in at least one alternate flowpath (e.g. shunt tubes or conduits).

A well tool comprised of a central conduit with or without a polished or profiled internal diameter (ID) having connector means thereon (i.e. threaded coupling and external threads) connects the respective ends of joints together. A sleeve is concentrically mounted on the outside said conduit with at least one by-pass tube positioned within annulus between the conduit and the sleeve. The by-pass tubes are spaced to align with and to fluidly-connect respective shunt tubes on adjacent joints together when the tool is assembled.

Mounted onto sleeve is a packing means which is preferably comprised of two sets of cup packers with backup rings; one set having one or more upwardly-facing cup packers and the other set having one or more downwardly-facing cup packers. Also, positioned on the sleeve between the sets of cup packers is a multi-bladed centralizer.

To assemble the well screen, the well tool is connected to respective ends of two adjacent joints of well screen and is properly torqued to axially align each by-pass tube within the well tool with the respective shunt tubes on each of the joints. Next, the respective by-pass tubes and the aligned shunt conduits are fluidly connected together by appropriate connectors.

In operation, the well screen is lowered on a workstring and is positioned so that packer means on the well tool will lie within the interval to be gravel-packed. A gravel slurry is pumped into and down the workstring and into the well annulus around the well screen. The gravel flows through the shunt conduits on one of the joints, through the by-pass tubes in the well tool, and through the respective shunt conduits on the other joint to provide a good distribution of gravel throughout the interval.

When a zone within the interval "waters-out", flow from that zone into well screen normally will be blocked (e.g. by cementing, closing an appropriate sliding sleeve, or the like) as will be understood by those skilled in this art. The packing means on the well tool prevents any substantial flow through the annulus between zones thereby preventing the water from the watered-out zone from flowing through the annulus into the well screen adjacent to a zone that is still under production.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
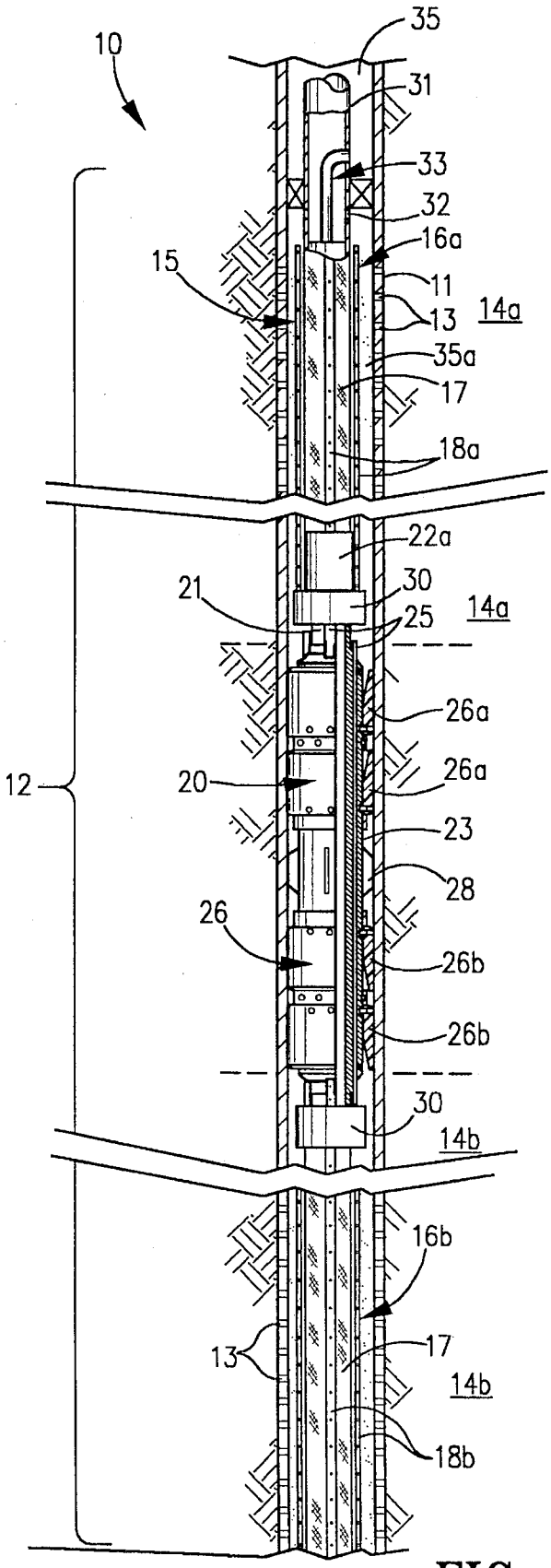
FIG. 1 is a broken-away, elevational view, partly in section, of the present well tool incorporated into a well screen having alternate flowpaths which has been installed into a wellbore.
Figure 2:
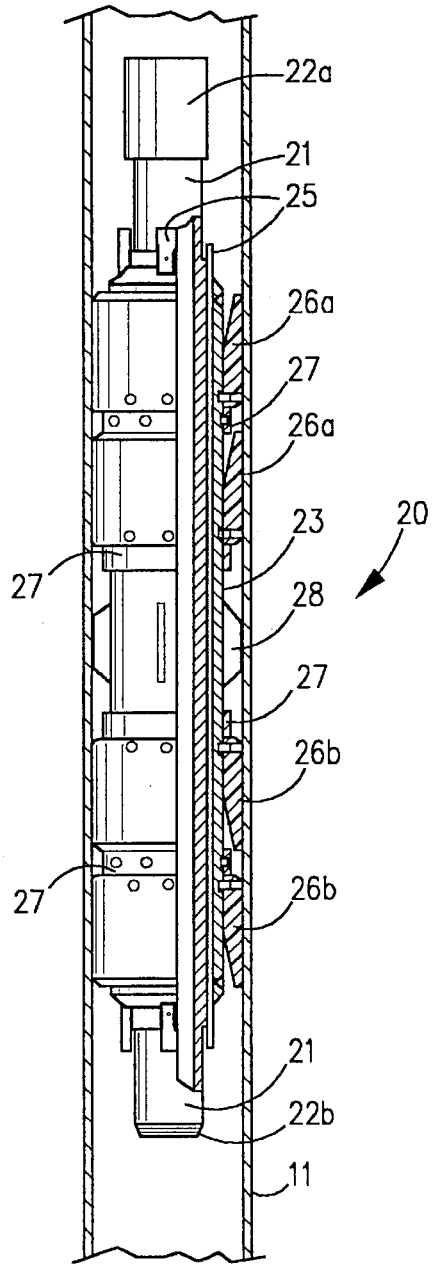
FIG. 2 is an enlarged, elevational view, partly in section, of the well tool of FIG. 1.

Referring more particularly to the drawings, FIG. 1 illustrates the lower end of a wellbore 10 having a casing 11 extending through a production interval 12 which is to be gravel packed. Casing 11 has perforations 13 adjacent at least two productive zones 14*a*, 14*b* of the subterranean, productive formation(s) which forms interval 12. Well screen 15 is positioned within the wellbore 10 and extends through interval 12.

More particularly, well screen 15 is shown as being comprised of a plurality of lengths or "joints" 16*a*, 16*b* which are substantially similar in basic construction (only part of two adjacent joints 16*a*, 16*b* are shown in FIG. 1) Each joint is comprised of a length or section of screen 17 or the like. The term "screen" is used generically herein and is meant to include and cover any and all types of permeable structures commonly used by the industry in gravel pack operations which permit flow of fluids therethrough while substantially blocking the flow of particulates (e.g. commercially-available screens, slotted or perforated liners or pipes, screened pipes, prepacked screens, porous or permeable pipes, and/or liners, or combinations thereof) Also, as will be understood in this art, some or all of the joints may also include length(s) of blank pipe (not shown) in addition to the screen section if a particular operation so dictates.

Positioned on each joint 16*a*, 16*b* is at least one perforated, shunt tubes or conduits 18 (e.g. four, radially spaced at 90° intervals) which are parallel to each other and which extend axially along the entire length of joint 16*a*, 16*b*. Shunt conduit(s) 18*a*, 18*b* may be extend either externally along joint 16*a*, 16*b* (as shown) or internally of joint 16*a*, 16*b* and/or screen section 17 (not shown) or both.

Coupled into well screen 15 between joints 16*a*, 16*b* is well tool 20 in accordance with the present invention. Tool 20 is comprised of a central conduit 21 with or without a polished or profiled ID which has appropriate connector means thereon (i.e. threaded coupling 22*a* and external threads 22*b*) for connecting tool 20 to the respective ends of adjacent joints 16*a*, 16*b*. A sleeve 23 is mounted on the outside of said conduit 21 to provide a space therebetween. At least one by-pass tube 25 (i.e. the same numbers as the number of shunt tubes 18*a*, 18*b* on each respective joint 16*a*, 16*b*) are positioned within this space. The by-pass tube(s) is arranged to align with respective shunt tubes 18*a*, 18*b* on joints 16*a*, 16*b* when tool 20 is assembled. Each by-pass tube 25 extends completely through sleeve 23 so that the respective ends of each tube is exposed for a purpose discussed below.

Mounted onto the external surface of sleeve 23 is packing means 26. Preferably, packing means 26 is comprised of two sets of cup packers with backup rings 27 (e.g. Guiberson "CP" Cups, Guiberson/Dresser Industries, Houston, Tex.); one set having one or more (two shown) upwardly-facing cups 26*a* and the other set having one or more downwardly-facing cups 26*b*. Positioned on sleeve 23 between the sets of packers is a multi-bladed centralizer 28 (four blades at 90° interval are shown).

To assemble well screen 15, the respective connector means 22 of well tool 20 are connected to the respective ends of two adjacent joints 16*a*, 16*b* and are properly torqued so that each by-pass tube 25 is axially-aligned with a respective shunt tube 18*a*, 18*b* on each of the joints 16*a*, 16*b*. Next, the ends of each by-pass tube 25 are fluidly-connected to the ends of respective, aligned shunt conduits by either separate, individual connectors (not shown) or by a single connector 30 (see U.S. Pat. No. 5,390,966, incorporated herein by reference).

In operation, once well screen 15 has been assembled, it is connected onto the lower end of workstring 31 and is lowered into wellbore 10 and positioned so that packer means 26 will lie between zones 14*a*, 14*b* of production interval 12. Interval 12 is then gravel-packed from the "top down" or from the "bottom up" as the case may be. For example, a gravel slurry is pumped down workstring 31, out ports 32 in "cross-over" 33, and into the top of well annulus 35 below packer 36. The gravel fills the annulus 35*a* above packing means 26 either directly and/or through the perforations in shunt tubes 18*a*, 18*b* even if a "sand bridge" occurs before the operation is complete.

Slurry also flows through shunt tubes 18*a*, through by-pass tubes 25, and out shunt tubes 18*b* to fill the well annulus 35*b* which lies below packing means 26. Of course, in some instances, circulation of the gravel slurry can be reversed to fill the annulus from the "bottom up" if desired. In any event, the by-pass tubes 25 in tool 20 allows slurry to flow past packer means 26 during the gravel pack operation so that a good gravel distribution is obtained over the entire interval 12.

As will be understood in the art, either zone 14*a* or 14*b* may "water-out" before the other zone so that substantially only water will be produced from the watered-out zone. At this point in the operational life of the well, flow from the watered-out zone into well screen 15 will normally be blocked (e.g. by filling the lower end of well screen 15 with cement, closing a sliding sleeve, or the like). In the past without the present tool 20, substantial flow of water could still occur through the highly-permeable, gravel-packed well annulus surrounding the well screen. Accordingly, water could flow up annulus 35 and enter unblocked, well screen 15 adjacent the still producing zone 14*a* or 14*b*, as the case may be. However, with well tool 20, even though a small volume of water (e.g. 10% of normal flow) may flow between zones through the gravel-filled shunt tube(s) 18*a*, 18*b* and by-pass tube(s) 25, packing means 26 prevents any substantial flow in the annulus between zones in either direction (i.e. cups 26*a* prevent downward flow while cups 26*b* prevent upward flow) whereby any substantial flow from the watered-out zone cannot enter the well screen adjacent the still producing zones.

What is claimed is:

1. A well screen for gravel-packing an interval within a wellbore, said well screen comprising:

at least two joints, each of said joints comprising:
a length of screen section; and
at least one axially-extending shunt conduit carried by screen section; and a well tool for connecting said at least two joints together, said well tool comprising:
at least one by-pass tube axially aligned and forming a fluid path between said at least one axially-extending shunt conduit on each of said joints; and
means on said well tool for preventing any substantial annular, axial flow of fluids past said tool when said well screen is in an operable position within the wellbore.

2. The well screen of claim 1 wherein said means for preventing annular axial flow comprises:

packing means mounted on the exterior of said well tool.

3. The well screen of claim 2 wherein said packing means comprises:

at least one upward-facing cup packer mounted on said tool; and at least one downward-facing cup packer mounted on said tool.

4. A well screen for gravel-packing an interval within a wellbore, said well screen comprising:

at least two joints, each of said joints comprising:
a length of screen section; and
at least one axially-extending shunt conduit carried by screen section; and a well tool for connecting said at least two joints together, said well tool comprising:
a central conduit;
at least one by-pass tube axially aligned on said central conduit and forming a fluid path between said at least one axially-extending shunt conduit on each of said joints; and
means on well tool for preventing any substantial annular, axial flow of fluids past said tool when said well screen is in an operable position within the wellbore.

5. The well screen of claim 4 wherein said well tool further comprises:

a sleeve mounted on the outside of said central conduit;

and wherein said means for preventing annular axial flow comprises:

packing means mounted on the exterior of said sleeve.

6. The well screen of claim 5 wherein said packing means comprises:

at least one upward-facing cup packer mounted on said sleeve; and at least one downward-facing cup packer mounted on said sleeve and axially-spaced from said at least one upward-facing cup packer.

7. The well screen of claim 6 including:

a centralizer mounted on said sleeve intermediate said upward-facing cup packer and said downward-facing cup packer.

8. The well screen of claim 7 wherein said at least one by-pass tube comprises:

a plurality of axially-extending by-pass tubes positioned between said central conduit and said sleeve.

9. A well tool for connecting at least two joints of well screen together, said well tool comprising:

a central conduit;

at least one by-pass tube axially aligned on said central conduit and adapted to form a fluid path between at least one axially-extending shunt conduit on each of said joints when connected together; and means on well tool for preventing any substantial annular, axial flow of fluids by said tool when said well screen is in an operable position within the wellbore.

10. The well tool of claim 9 further comprises:

a sleeve mounted on the outside of said central conduit;

and wherein said means for preventing axial flow comprises:

packing means mounted on the exterior of said sleeve.

11. The well screen of claim 10 wherein said packing means comprises:

at least one upward-facing cup packer mounted on said sleeve; and at least one downward-facing cup packer mounted on said sleeve and axially-spaced from said at least one upward-facing cup packer.

12. The well screen of claim 11 including:

a centralizer mounted on said sleeve intermediate said upward-facing cup packer and said downward-facing cup packer.

13. The well screen of claim 12 wherein said at least one by-pass tube comprises:

a plurality of axially-extending by-pass tubes positioned between said central conduit and said sleeve.

* * * * *